US005394164A

United States Patent [19]

Gandhi et al.

[11] Patent Number: 5,394,164

[45] Date of Patent: Feb. 28, 1995

[54] HUMAN-EQUIVALENT ANTENNA FOR ELECTROMAGNETIC FIELDS

[75] Inventors: Om P. Gandhi, Salt Lake City, Utah; Edward E. Aslan, Plainview, N.Y.

[73] Assignee: The Narda Microwave Corp., Hauppauge, N.Y.

[21] Appl. No.: 915,095

[22] Filed: Jul. 16, 1992

[51] Int. Cl.[6] ..... H01Q 9/30

[52] U.S. Cl. ..... 343/831; 343/703; 343/880

[58] Field of Search ..... 343/831, 703, 829, 828, 343/825, 826, 893, 878, 879, 880, 901, 900, 881; 324/95, 72.5; H01Q 9/30

[56] References Cited

U.S. PATENT DOCUMENTS 3,922,684 11/1975 Wright ..... 343/831
3,931,573 1/1976 Hopfer ..... 343/703
4,207,518 6/1980 Hopfer ..... 343/703
4,392,108 7/1983 Hopfer ..... 343/703

*Primary Examiner*—Donald Hajec
*Assistant Examiner*—Hoanganh Le
*Attorney, Agent, or Firm*—Hoffmann & Baron

[57] ABSTRACT

An antenna for use in measuring current induced in a human body from exposure to radio frequency, electromagnetic fields approximates the impedance the human body over a wide frequency band of operation. The antenna includes an elongated resistive strip secured to a rigid supporting member, the supporting member and resistive strip being mounted on a supporting base plate. The antenna obviates the need for a human subject to be exposed to electromagnetic fields which need to be assessed to determine whether the induced current exceeds permissible guidelines. The antenna is collapsible so that it is easily transported to any desired location.

8 Claims, 3 Drawing Sheets

HUMAN-EQUIVALENT ANTENNA FOR ELECTROMAGNETIC FIELDS

BACKGROUND OF THE INVENTION

1. Field of the Invention

The present invention relates to antennas, and more specifically relates to an antenna for use in measuring current induced in a human body from exposure to radio frequency, electromagnetic fields.

2. Description of the Prior Art

Recently proposed modifications in the safety guidelines with respect to human exposure to radio frequency, electromagnetic fields require measurements of induced body currents to ascertain that these currents are lower than maximum allowable currents. The induced body currents that are measured represent the amount of current passing through the feet of an individual to ground. The current passing through an individual exposed to electromagnetic fields has only recently become a safety concern.

Limits on body to ground current for workers exposed to radio frequency, electromagnetic fields have recently been proposed by the International Radiation Protection Association (IRPA) of the World Health Organization (WHO), in Canada and other foreign nations such as the United Kingdom. The Institute of Electronic and Electrical Engineers (IEEE) has determined safety levels with respect to human exposure to radio frequency, electromagnetic fields between 3 KHz to 300 GHz (IEEE C95.1-1991). The American National Standards Institute (ANSI) has also been considering publishing a revised national standard safety level with respect to human exposure to radio frequency, electromagnetic fields. Exposure to radio frequency, electromagnetic fields has been determined to create some health hazards to workers.

Due to the health hazards with respect to human exposure to radio frequency, electromagnetic fields, it is necessary for employers to monitor workers who are exposed to such fields. Therefore, there is a need for a reliable, portable, accurate human-surrogate antenna that will approximate the current induced by electromagnetic fields that would pass through the feet of an individual to be monitored. The human-surrogate or human-equivalent antenna would thereby obviate the need for human exposure to radio frequency, electromagnetic fields that need to be assessed for safety.

OBJECTS AND SUMMARY OF THE INVENTION

It is an object of the present invention to provide a human-equivalent antenna which approximates the current induced in a human body exposed to radio frequency, electromagnetic fields.

It is another object of the present invention to provide a human-equivalent antenna which is portable.

It is a further object of the present invention to provide a human-equivalent antenna which is accurate to within ±10% with respect to induced current permitted to flow through the antenna in comparison to the actual current which would flow through a human to ground over a wide band of operation.

It is still another object of the present invention to provide a human-equivalent antenna which obviates the need for human exposure to radio frequency, electromagnetic fields that need to be assessed for safety.

It is yet another object of the present invention to provide a human-equivalent antenna which may be used in conjunction with a metering device for measuring current which would flow through a human body exposed to radio frequency, electromagnetic fields.

In accordance with one form of the present invention, a human-equivalent antenna includes at least one elongated resistive strip having a predetermined length. The resistive strip is secured to a supporting structure which is mounted on a base. The resistive strip and supporting structure are preferably constructed of several sections which can be folded into a compact assembly for convenience of portability. The base may be formed from a metal to serve not only as a mounting point for the supporting structure and resistive strip but also as a terminal to which the bottom of the resistive strip is connected. In order to enhance the performance of the human-equivalent antenna at high frequencies, an auxiliary rod antenna having a predetermined impedance is preferably mounted to the metallic base and disposed parallel to the resistive strip antenna element. The auxiliary rod antenna is constructed so that it is retractable within itself, i.e., telescopic similar to a retracting auto antenna, for convenience of portability.

DETAILED DESCRIPTION OF THE PREFERRED EMBODIMENTS

Figure 1:
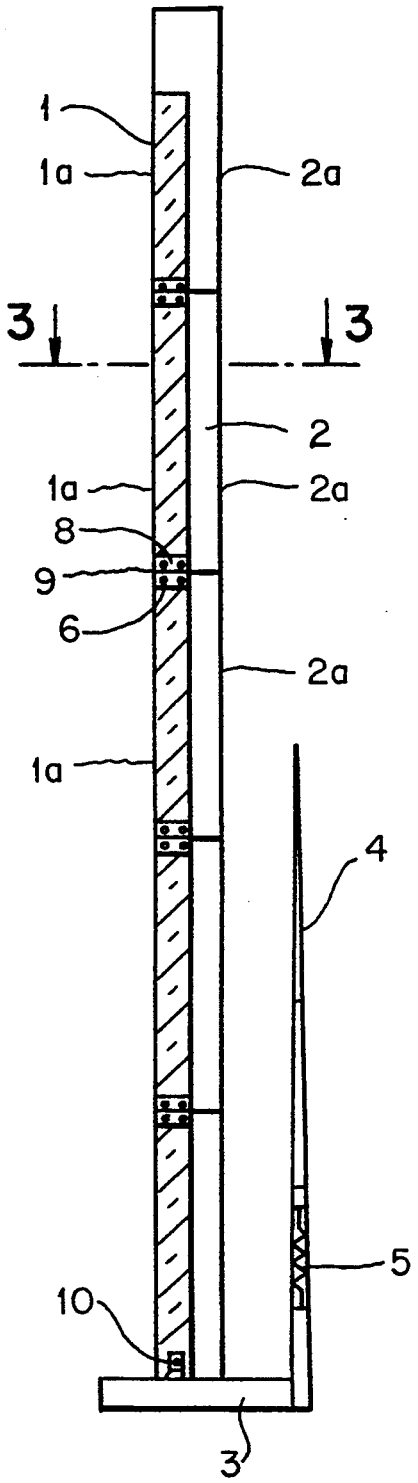
FIG. 1 is a front view of a human-equivalent antenna, formed in accordance with one form of the present invention.
Figure 3:
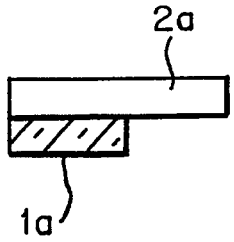
FIG. 3 is a cross sectional view of the antenna of the present invention shown in FIG. 1, taken along line 3—3 of FIG. 1.

A human-equivalent antenna approximating the overall impedance of a human body over a wide range of frequencies, formed in accordance with the present invention, is constructed using an elongated strip of resistive material 1 supported on and electrically coupled to a plate-like base 3 as illustrated in FIGS. 1 and 3. The resistive strip 1 is preferably secured to an elongated supporting structure 2 by adhesive or fasteners to maintain the resistive strip 1 in a rigid, vertical position, perpendicularly disposed to the plate-like base 3.

The resistive strip 1 of the present invention has a predetermined length and impedance. Preferably, the strip is formed of a material having a resistance of 40 ohms per linear foot length and has a length of approximately 175 cm. Also, the resistive strip 1 preferably has a width of approximately one inch. The resistance and length of the resistive strip 1 is preferably such that it approximates the overall impedance of a human body. The width of the resistive strip 1 enhances the response of the human-equivalent antenna to radio frequency, electromagnetic fields approximating a human body.

The supporting structure 2 for the resistive strip 1 is preferably formed from any rigid, non-conductive material. Materials suitable for use as the supporting structure 2 include but are not-limited to ceramic, plastics or wood. The supporting structure 2 may be formed of a single continuous structure. However, in a preferred form of the invention, the supporting structure 2 is formed from several separate sections 2*a*, each having a corresponding resistive strip section 1*a* secured to it. Adjacent strip sections 1*a* and supporting sections 2*a* are respectively connected together by removable fasteners, such as bolts 6, passing through the sections, and electrically conductive jumper plates 8 which are mounted on the facing ends of the adjacent sections 1*a*, 2*a* and bridge the gap between the sections. The jumper plates 8 not only electrically couple adjacent resistive strip sections 1*a* together and support the resistive strip and support structure in an upright position on the base, but also allow the sections to be joined or unjoined for transportation or storage. Even more preferably, each jumper plate may be formed with a pivoting hinge 9, so that the support structure and strip may be folded into a compact assembly. The hinged resistive strip 1 and support structure 2 make the human-equivalent antenna of the present invention easily transportable.

The resistive strip 1 and support structure 2 formed in accordance with the present invention are mounted perpendicularly to the center of a plate-like base 3 by an electrically conductive L-shaped bracket 10 or the like secured to the resistive strip and the base. The base 3 is preferably formed of a sturdy metallic material to support the antenna strip element in an upright position. Materials suitable for use as a base 3 of the present invention include, but are not limited to, metallic materials such as aluminum, copper and brass. In the preferred embodiment of the present invention, the base 3 is formed of a conductive material to provide a terminal to which the bottom of the resistive strip 1 may be connected as well as providing a sturdy support base for the resistive strip 1 and supporting structure 2 of the antenna. The base 3 of the preferred embodiment is circular in shape having a diameter of approximately 8.4 cm and a thickness of approximately 3 cm.

The human-equivalent antenna of the present invention may also include an auxiliary rod antenna element 4 to improve the antenna response at higher frequencies. The auxiliary rod antenna element 4 is preferably formed from an elongated length of metal, preferably having a length of approximately 84 cm. Near the base of the auxiliary rod antenna element 4, a non-inductive resistor 5 having a resistance of approximately 125 ohms is connected within the induced current path of the auxiliary rod antenna 4 to limit the induced current flowing through the auxiliary rod antenna 4 to ground. In the preferred embodiment of the present invention, the auxiliary rod antenna element 4 is mounted to a lateral side of the base 3 and disposed in parallel with but spaced apart from resistive strip element 1. In the preferred embodiment, the auxiliary rod antenna element 4 is spaced approximately 4.2 cm from the resistive strip element 1. The auxiliary rod antenna 4 is preferably formed from a retractable or telescopic metal antenna which operates similar to a retractable car radio antenna. Since the auxiliary rod antenna 4 and support structure 2 and resistive strip 1 are collapsible, the entire human-equivalent antenna of the present invention is easily transported or stored.

The human equivalent antenna shown in FIG. 1 having the dimensions and linear resistance described previously generates an induced current which is 80% of that induced in a human subject. A resistive strip element 1 having a lower linear resistance, for example, 25 ohms per foot, would induce a current which would be substantially equal to that induced in a human subject for the same electromagnetic field conditions. However, such a low resistance would make the resistance of the antenna small relative to the reactance and result in a high Q and accordingly, a narrow band of operation.

Figure 4:
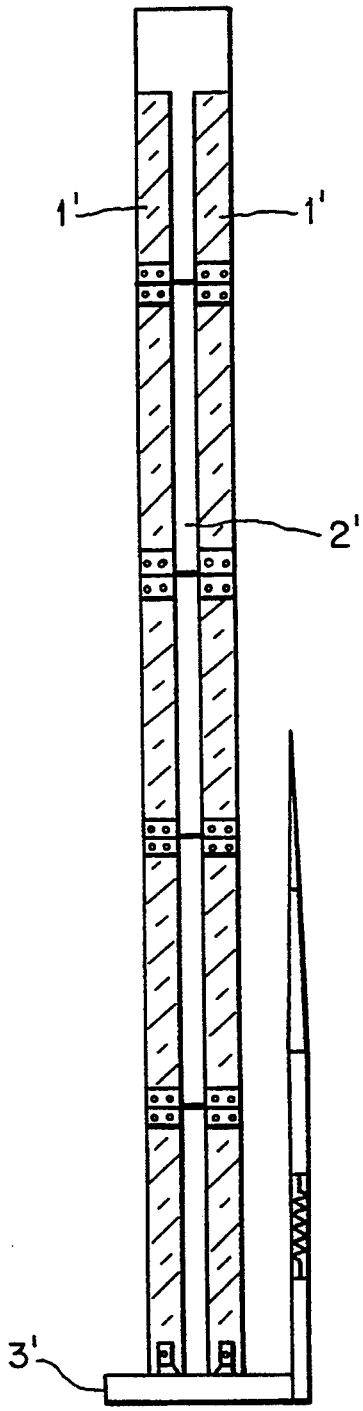
FIG. 4 is a front view of another embodiment of a human equivalent antenna formed in accordance with the present invention.

An alternative embodiment of the present invention which increases the induced current flow through the antenna and yet provides a broad operating band width is illustrated by FIG. 4. A pair of resistive strip elements 1', arranged side-by-side in parallel and spread apart by a fraction of an inch is mounted on a supporting structure 2' which, in turn, is mounted on a plate-like support base 3'. The resistive strip elements 1', supporting structure 2' and base 3' are formed from the same material and have the same structure as their corresponding components of the embodiment shown in FIG. 1. Each resistive strip element 1' is coupled to the base 3' in the same manner as described previously with respect to the embodiment of FIG. 1. However, the linear resistance of each strip is about 50 ohms per foot. The effective resistance of the antenna is 25 ohms per foot, as the two strip elements 1' are considered effectively in parallel. Thus, each resistive strip has a low Q (as its resistance is relatively large when compared to its reactance), yet together the strips provide the antenna with an effective resistance of 25 ohms per foot, which increases the current induced in the antenna by the electromagnetic field so that it is substantially equal to the current induced in a human subject for the same field.

Figure 2:
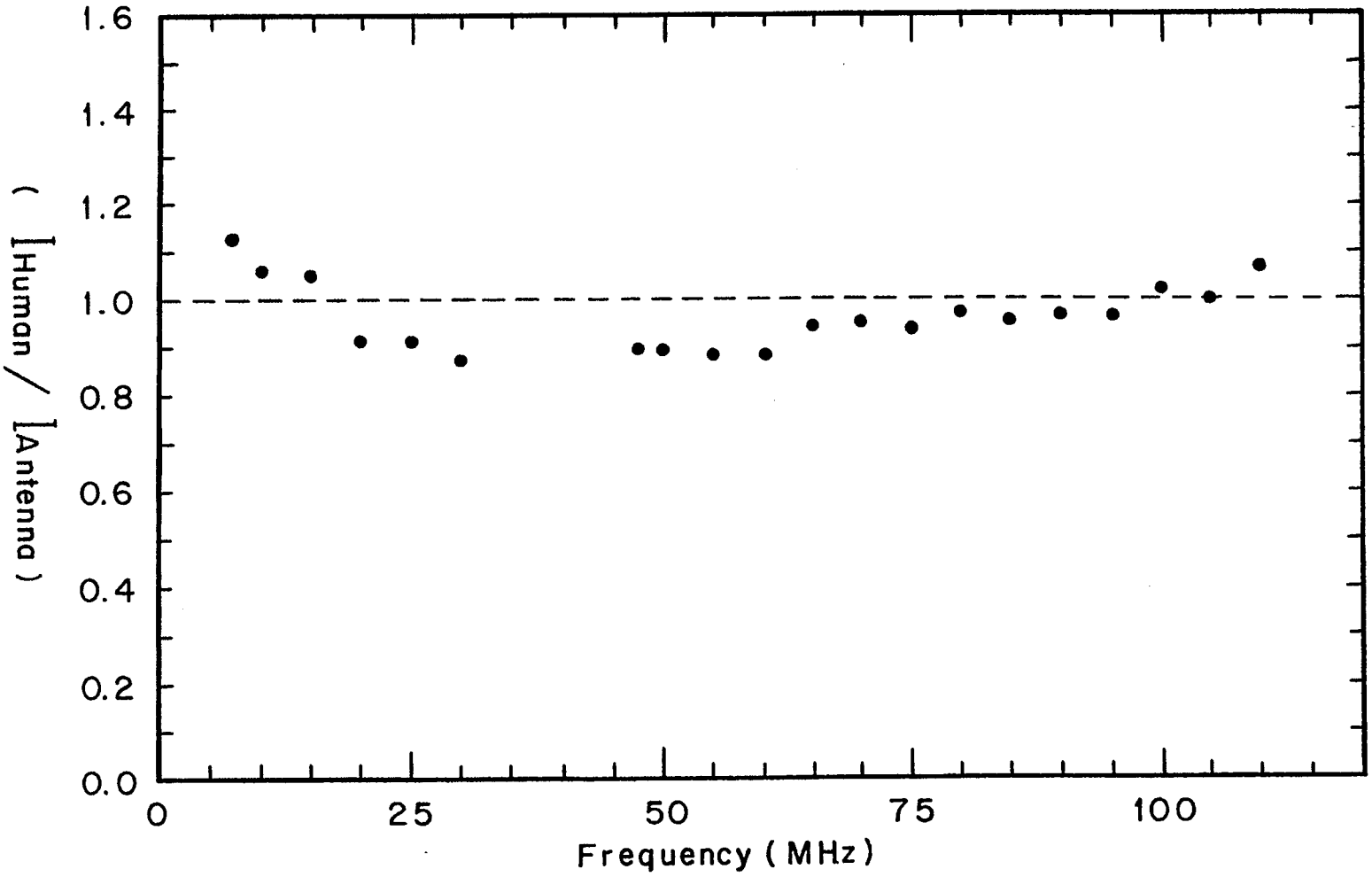
FIG. 2 is a graph showing the response of the human-equivalent antenna as compared to that of an actual human with respect to frequency.

Referring to FIG. 2, the human-equivalent antenna of the present invention has been tested for accuracy for the frequency band 7–110 MHz. FIG. 2 is a graph showing the overall response of the antenna. The vertical axis represents a ratio equal to the current induced by radio frequency, electromagnetic fields measured for a human subject ($I_{human}$) divided by the induced current as measured using the human-equivalent antenna ($I_{antenna}$) of the present invention. The horizontal axis corresponds to the field frequency at which the induced current measurements were taken. The resultant ratio ($I_{human}/I_{antenna}$) is close to unity over the entire range of frequencies and deviates from unity by no more than ±10% for any given measurement. Even though testing for the human-equivalent antenna was not performed for frequencies lower that 7 MHz due to lack of facilities, the quasi-static nature of coupling is such that nearly identical results are anticipated for frequencies as low as 3 KHz.

The induced currents in the human subject and human-equivalent antenna were measured by using a current metering instrument such as a workstation mat described in co-pending application Ser. No. 07/863,833, filed Apr. 6, 1992, and entitled, "Induced Body Current Metering Workstation Mat" the disclosure of which is incorporated herein by reference. Measurements were taken with the human subject standing on the current metering instrument and by placing the entire human-equivalent antenna on the same instrument to determine $I_{human}$ and $I_{antenna}$, respectively.

As set forth in the foregoing description, the human-equivalent antenna of the present invention provides a surrogate for the human subject when measuring induced currents caused by radio frequency, electromagnetic fields for safety assessment. The human-equivalent antenna is highly accurate over a wide frequency band of operation. The human-equivalent antenna is collapsible, making it easily transportable to any desired location. Use of the human-equivalent antenna obviates the need for human exposure to radio frequency, electromagnetic fields which need to be assessed for safety.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A human-equivalent antenna for use in measuring electromagnetic field induced current which flows through a human body to ground, which comprises:

an electrically conductive base; and at least one elongated resistive strip having a first end, said first end being electrically coupled to the base, said resistive strip having a predetermined length and resistivity such that the strip approximates the impedance of a human body exposed to electromagnetic fields, the at least one resistive strip having a current induced therein when the resistive strip is exposed to an electromagnetic field, the induced current approximating the current induced in and flowing through a human body to ground when the human body is exposed to the electromagnetic field.

2. A human-equivalent antenna as defined by claim 1, which further includes a strip supporting structure, the resistive strip being mounted to the supporting structure, the supporting structure being mounted to the base at said first end of said resistive strip.

3. A human-equivalent antenna as defined by claim 2, wherein the supporting structure comprises a rigid, non-conductive material.

4. A human-equivalent antenna as defined by claim 1, wherein the resistive strip is approximately 175 cm in length and 1 inch in width; and the resistive strip resistance is approximately 40 ohms per linear foot length.

5. A human-equivalent antenna for use in measuring electromagnetic field induced current which flows through a human body to ground, which comprises:

a base;

at least one elongated resistive strip having a first end, said first end being coupled to the base, said resistive strip having a predetermined length and resistivity such that the strip approximates the impedance of a human body exposed to electromagnetic fields; and a strip supporting structure, the resistive strip being mounted to the supporting structure, the supporting structure being mounted to the base at said first end of said resistive strip, wherein each of the supporting structure and resistive strip comprises a plurality of sections, adjacent sections of the supporting structure and resistive strip being respectively connectable together.

6. A human-equivalent antenna for use in measuring electromagnetic field induced current which flows through a human body to ground, which comprises:

a base;

at least one elongated resistive strip having a first end, said first end being coupled to the base, said resistive strip having a predetermined length and resistivity such that the strip approximates the impedance of a human body exposed to electromagnetic fields; and an auxiliary rod antenna element having a first end coupled to said base, said auxiliary rod antenna element comprising:

an elongated length of electrically conductive material; and a non-inductive resistor connected within the induced current path of the length of conductive material.

7. A human-equivalent antenna as defined by claim 6, wherein the auxiliary rod antenna element comprises a plurality of sections, the sections being retractable.

8. A human-equivalent antenna for use in measuring electromagnetic field induced current which flows through a human body, which comprises:

an electrically conductive base;

a supporting structure mounted on the base; and a pair of elongated resistive strips, the resistive strips being arranged side-by-side and parallel to each other and being mounted on the supporting structure and electrically coupled to the base, the resistive strips having predetermined lengths and resistivities such that together the strips approximate the impedance of a human body exposed to electromagnetic fields, the pair of elongated resistive strips having a current induced therein when the resistive strips are exposed to an electromagnetic field, the induced current approximating the current induced in and flowing through a human body to ground when the human body is exposed to the electromagnetic field.

* * * * *